US009988904B2

(12) United States Patent
Siepenkort et al.

(10) Patent No.: US 9,988,904 B2
(45) Date of Patent: Jun. 5, 2018

(54) PLOW BIT ASSEMBLY

(71) Applicant: Caterpillar Global Mining Europe GmbH, Lünen (DE)

(72) Inventors: Gerhard Siepenkort, Lünen (DE); Uwe Tillessen, Kamen (DE); Klaus Duhnke, Werne (DE); Susanne Wutzke, Holzwickede (DE); Diedrich Bettermann, Unna (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 0 days. days.

(21) Appl. No.: 15/313,379

(22) PCT Filed: May 22, 2015

(86) PCT No.: PCT/EP2015/001061

§ 371 (c)(1),
(2) Date: Nov. 22, 2016

(87) PCT Pub. No.: WO2015/185188

PCT Pub. Date: Dec. 10, 2015

(65) Prior Publication Data

US 2017/0183965 A1 Jun. 29, 2017

(30) Foreign Application Priority Data

Jun. 3, 2014 (EP) ..... 14170975

(51) Int. Cl.
*E21C 27/44* (2006.01)
*E21C 35/193* (2006.01)
*E21C 27/36* (2006.01)

(52) U.S. Cl.
CPC ..... *E21C 35/193* (2013.01); *E21C 27/36* (2013.01); *E21C 27/44* (2013.01)

(58) Field of Classification Search
CPC .. E21C 27/44; E21C 35/18; E21C 2035/1806; E21C 35/19; E21C 2035/191;
(Continued)

(56) References Cited

U.S. PATENT DOCUMENTS 3,256,043 A * 6/1966 Krekeler ..... E21C 35/19 279/128
3,945,681 A * 3/1976 White ..... E21C 35/19 299/107

(Continued)

FOREIGN PATENT DOCUMENTS

DE 3122868 C2 12/1982
DE 3242144 A * 5/1984

(Continued)

OTHER PUBLICATIONS

International Search Report dated Feb. 22, 2016, issued in PCT/EP2015/001061 (3 pages).

(Continued)

*Primary Examiner* — Sunil Singh

(57) ABSTRACT

A plow bit for a bit holder including a recess of a mining plow is disclosed. The plow bit also has a bit shank configured to be inserted into the recess of the bit holder. The bit shank has a front shank face, which is concave. The bit shank also has a rear shank face disposed on an opposite side of the bit shank with respect to the front shank face. The bit shank further has a first lateral shank face connected to the front shank face and the rear shank face. The first lateral shank face includes a first groove extending from the front shank face in direction of the rear shank face. The groove receives a securing pin.

10 Claims, 5 Drawing Sheets

(58) Field of Classification Search
CPC . E21C 35/193; E21C 35/1933; E21C 35/1936
USPC ..... 299/112 R, 79.1, 103, 108, 109, 112 T
See application file for complete search history.

(56) References Cited

U.S. PATENT DOCUMENTS

| | | | | |
|---|---|---|---|---|
| 4,609,227 | A * | 9/1986 | Wild | E21C 35/18 299/103 |
| 4,744,605 | A | 5/1988 | Komotzki | |
| 7,073,870 | B2 | 7/2006 | Tillessen et al. | |
| 7,310,897 | B2 | 12/2007 | Tillessen et al. | |
| 7,393,061 | B2 | 7/2008 | Hesse | |

FOREIGN PATENT DOCUMENTS

| | | | | |
|---|---|---|---|---|
| DE | 3308370 | C1 | | 9/1984 |
| DE | 3317145 | A1 | * | 11/1984 |
| DE | 3439508 | A1 | | 3/1986 |
| DE | 3531781 | C1 | | 1/1987 |
| DE | 3608786 | A1 | | 9/1987 |
| DE | 3828942 | A1 | | 3/1990 |
| DE | 3927285 | | * | 2/1991 |
| DE | 9108027 | | * | 9/1991 |
| DE | 9108027 | U1 | | 9/1991 |
| DE | 4105238 | | * | 8/1992 |
| DE | 4431701 | | * | 3/1996 |
| DE | 29803944 | | * | 4/1998 |
| DE | 29803944 | U1 | | 4/1998 |
| DE | 29901986 | U1 | | 4/1999 |
| DE | 19928288 | A1 | | 12/2000 |
| DE | 10161015 | A1 | * | 6/2003 |
| DE | 20320161 | U1 | | 3/2004 |
| DE | 20320163 | U1 | | 3/2004 |
| DE | 20320164 | U1 | | 3/2004 |
| DE | 202004005920 | U1 | | 6/2004 |
| FR | 2536113 | A | * | 5/1984 |
| GB | 700096 | | * | 11/1953 |
| GB | 2178782 | | * | 2/1987 |
| GB | 2178782 | A | | 2/1987 |

OTHER PUBLICATIONS

European Search Report dated Oct. 20, 2014, issued in EP 14 17 0975 (2 pages).

* cited by examiner

FIG 6
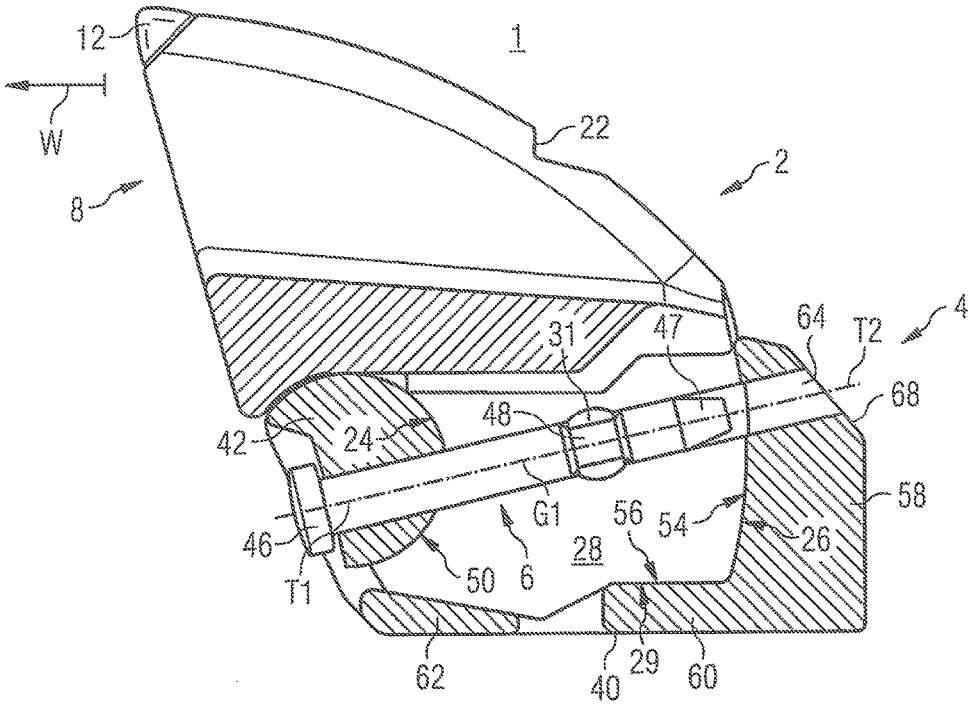
FIG 7 A-A
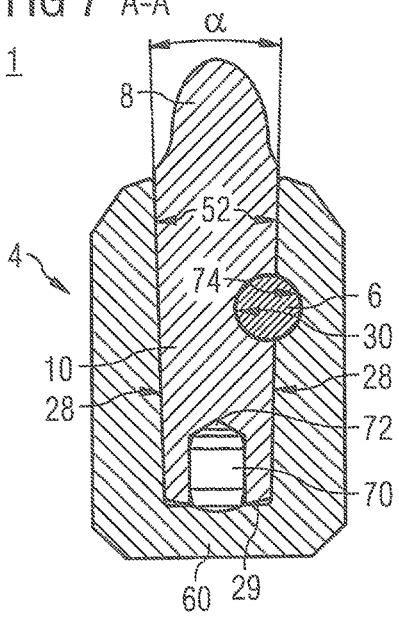

PLOW BIT ASSEMBLY

CLAIM FOR PRIORITY

This application is a U.S. National Phase entry under 35 U.S.C. § 371 from PCT International Application No. PCT/EP2015/001061, filed May 22, 2015, which claims benefit of priority of European Patent Application No. 14170975.8, filed Jun. 3, 2014, all of which are incorporated herein by reference.

TECHNICAL FIELD

The present disclosure generally relates to a mining plow. In addition, the present disclosure relates to a plow bit and a bit holder for holding the plow bit of a mining plow.

BACKGROUND

Mining plows used in underground mining for the extraction of material from a longwall face are equipped with a plurality of plow bits for each cutting direction. To ease replacement of those plow bits, each plow bit is typically disposed in a plow bit holder in a removable manner. Usually, the plow bit holders are secured to pivotable bit carriers of the mining plow, for example, by weld joints.

In case a plow bit may be worn or broken, the same is removed from the respective bit holder, and replaced by a new one. To remove the plow bit, a securing bolt or a securing wedge that locks the plow bit in a recess of the plow bit holder has to be removed.

For example, DE 36 08 786 A1 discloses a plow bit arrangement including a plow bit that is biased in a plow bit holder by an arch-shaped securing wedge. In an assembled state, the arch-shaped wedge contacts a ridge wall of the plow bit holder and a concave front face of the plow bit. The plow bit further includes a concave rear face that is supported by a convex protrusion of a rear wall of the bit holder in the assembled state.

As another example, DE 203 20 164 U1 discloses a plow bit arrangement. A plow bit is secured in an insert pocket of a bit holder by a securing bolt. Specifically, in an assembled state, a throughhole is provided in a ridge wall of the plow bit holder. Further, a lateral face of a bit shank of the plow bit includes an elongate groove. The groove is aligned with the throughhole such that the inserted securing bolt extending through the throughhole into the groove secures the plow bit in the recess of the bit holder.

Further, from DE 199 28 288 A1 a plow bit including a bit shank with a rounded front face is known. Additionally, the bit shank includes a cutout with an engaging portion for mounting a securing element.

Still further, GB 2 178 782 A related to a bit holder including a front wall with a rounded plow bit pocket face. A bore extends through the front wall for receiving a clamping sleeve to secure a wedge element, which clamps a cutter bit in the bit holder.

DE 101 61 015 A1 discloses a plow bit with an elastically deformable plastic pin accommodated in a recess in a bottom shank face.

The present disclosure is directed, at least in part, to improving or overcoming one or more aspects of prior systems.

SUMMARY OF THE DISCLOSURE

According to an aspect of the present disclosure, a plow bit for a bit holder including a recess of a mining plow is disclosed. The plow bit may comprise a bit shank configured to be inserted into the recess of the bit holder. The bit shank may further include a front shank face being concave, and a rear shank face disposed on an opposite side of the bit shank with respect to the front shank face. The bit shank may further comprise a first lateral shank face connected to the front shank face and the rear shank face. The first lateral shank face may include a first groove extending from the front shank face in direction to the rear shank face for receiving a securing pin.

According to another aspect of the present disclosure, a bit holder for a plow bit of a mining plow is disclosed. The bit holder may comprise a holder body including a front wall and a recess. The recess may be configured to receive the plow bit. The recess may further include a front recess face, which is convex and delimits the front wall. The front wall may include a first throughhole that may open in the front recess face.

According to yet another aspect of the present disclosure, a plow bit assembly for a mining plow is disclosed. The plow bit assembly may comprise a plow bit as exemplary disclosed herein, and a bit holder as exemplary disclosed herein. A front recess face of the bit holder and a front shank face of the plow bit may be configured to mate with one another to allow pivoting the plow bit into and out of the recess of the bit holder by a sliding contact between the front recess face and the front shank face.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings:

FIG. 6 shows a cut view of the plow bit assembly in an assembled state;

FIG. 7 shows a cut view of the plow bit assembly along cutting line A-A shown in FIG. 2.

DETAILED DESCRIPTION

Figure 1:
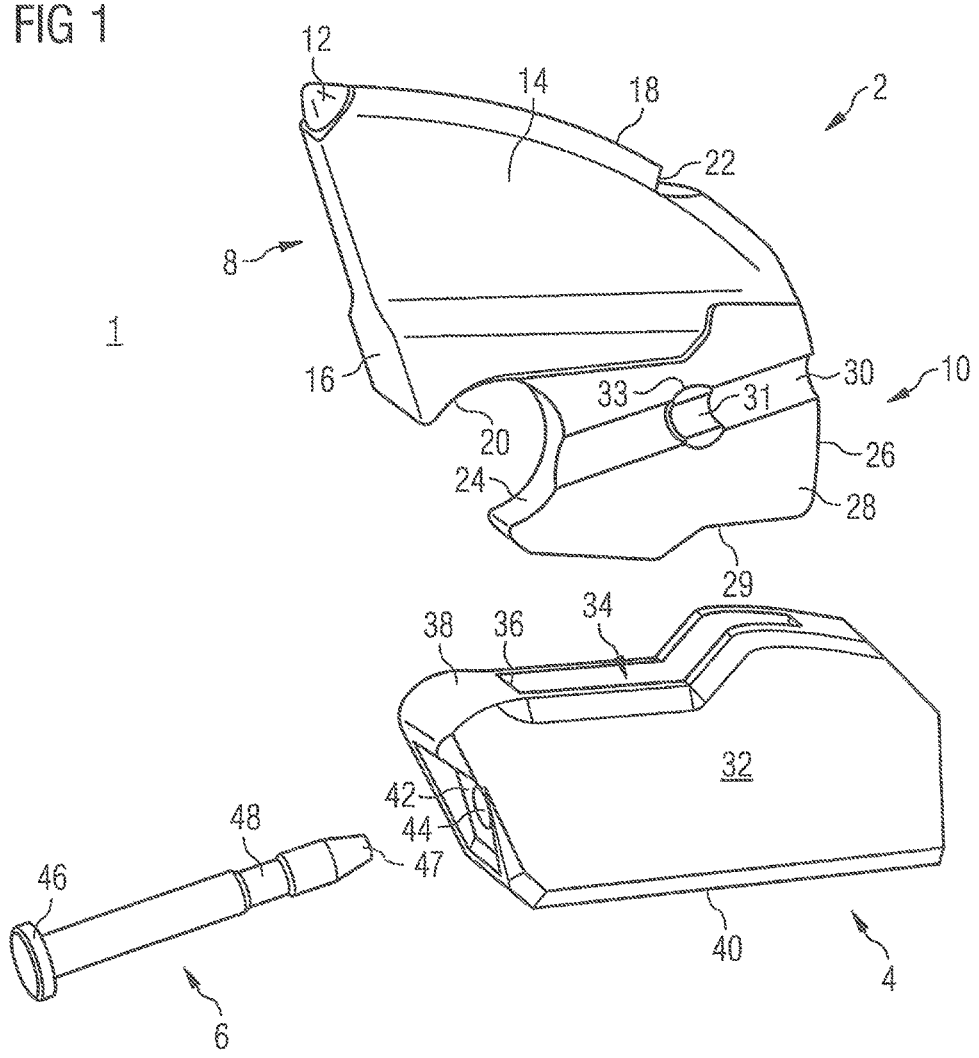
FIG. 1 shows an exploded view of an exemplary plow bit assembly with a plow bit, a bit holder, and a securing pin according to the present disclosure.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure is based at least in part on the realization that insertion of a plow bit into a bit holder, and removal of the plow bit from the bit holder may be difficult in the field due to various circumstances.

For example, insertion and removal of a plow bit requires space not only for the miner, but also for pulling a worn plow bit out of the bit holder, and for inserting a new one. Particularly bottom plow bits may be difficult to replace, and may require the miner to swivel out a respective bit carrier to a maximum, and may be also to lift the entire plow body to allow pulling out the worn bit to replace the same by a new one.

Moreover, particle ingress in the bit holder may negatively affect the removal of plow bits. During operation of the mining plow, dust, mineral particles and chips may intrude into the bit holder. As a consequence of enormous forces acting on plow bits and bit holders during mining operation, the particles situated between contacting faces of a plow bit and an associated bit holder may be compacted to briquettes. Those compacted accumulations may clamp the plow bit in the bit holder to such an extent that the plow bit may even get stuck in the bit holder. Therefore, considerable forces to pull out a worn plow bit may be needed. In addition, special removal tools may be necessary.

Before pulling out the plow bit from the bit holder, typically, a securing pin locking the plow bit in the bit holder has to be removed. However, as the securing pin head may be exposed to the rough environment during operation. Consequently, a worn securing pin including, for example, a worn or even demolished securing pin head, may be hard to remove.

The plow bit assembly as disclosed herein may at least in part better cope with the above noted difficulties in the field. Instead of pulling out worn plow bits from the bit holder and pushing new ones inside, the plow bit assembly as disclosed herein may be configured to swivel the plow bit inside and out of the bit holder. This configuration may reduce the space required for removal and insertion of the plow bit. Additionally, the plow bit assembly according to the present disclosure may include a new securing pin configuration which provides access to the securing pin tip. Thus, a worn or even (partially) broken securing pin may be removed by applying hammer and/or chisel impacts on the securing pin tip to push the securing pin out of the plow bit assembly.

As used herein, the terms "front" and "rear" are used in conjunction with a working direction (indicated, for example, by arrow W in FIG. 2) of the respective plow bit when mounted to the mining plow. In this respect, "front" typically characterizes an element that is directed or faces in direction of the working direction, whereas "rear" typically refers to an element directed or relatively positioned opposite to the working direction.

Further, the terms "top" and "bottom" as used herein are used with reference to a position of an element with respect to a working face of material to be mined. Accordingly, "top" typically characterizes an element that is directed or faces in direction of the working face, whereas "bottom" typically refers to an element directed away from the working face, which is also known as goaf side in mining.

Figure 2:
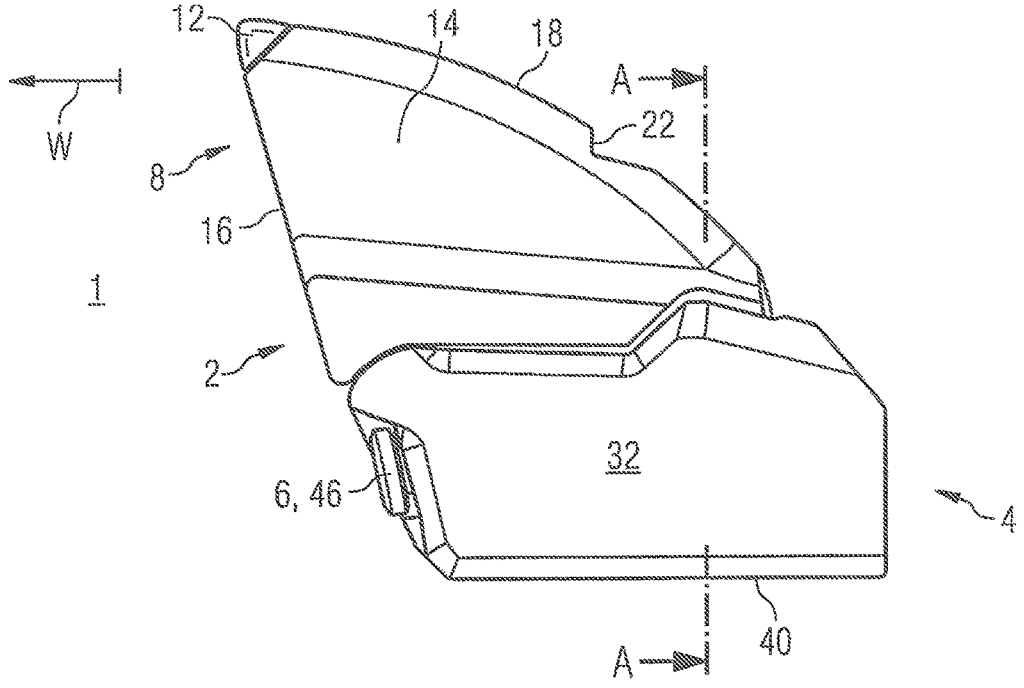
FIG. 2 shows a side view of the plow bit assembly in an assembled state.

Referring to FIGS. 1 and 2, an exemplary plow bit assembly 1 is depicted in an exploded view in FIG. 1, and, in an assembled state, in a side view in FIG. 2. Plow bit assembly 1 comprises a plow bit 2, a bit holder 4, and a securing pin 6.

Plow bit 2 includes a plow bit head 8 and a plow bit shank 10 (not visible in FIG. 2) connected to plow bit head 8. For example, bit head 8 and bit shank 10 may be integrally formed with one another. In the shown configuration, bit head 8 extends about an upper half of plow bit 2, and bit shank 10 about a lower half of plow bit 2. In an assembled state, bit shank 10 is substantially inserted in bit holder 4, whereas bit head 8 substantially protrudes out of bit holder 4.

At a tip of bit head 8, a cutting insert 12 is provided. Cutting insert 12 may be hardened and soldered-on at the tip of bit head 8. Additionally or alternatively, bit head 8 may include other and/or further cutting inserts such as hard alloy cutting plates or pins. A number and arrangement of those cutting inserts at a respective bit head may particularly depend on the intended designation of the plow bit at the associated mining plow. For example, bottom plow bits may be differently designed than roof plow bits.

In some embodiments, bit head 8 is delimited by two lateral head faces 14, one of which can be seen in FIGS. 1 and 2, a straight front head face 16, and a curved rear head face 18. Faces 14, 16, 18 may together form a wedge shape of bit head 8, wherein the wedge shape tapers in direction of cutting insert 12. Additionally, at a bottom section of bit head 8, the same may be widened to partially cover a recess 34 in bit holder 4 for reducing particle ingress.

In a front bottom section of bit head 8, in which the same is not connected to bit shank 10, a concave bottom head face 20 is provided. Bottom head face 20 may smoothly transition into a concave front shank face 24 of bit shank 10. Further, bottom face 20 may be at least partially concavely formed as circular arc.

At about a middle height of rear face 18 of bit head 8, a notch (shoulder) 22 is disposed. Said notch 22 may include two faces connected to one another via a rounding or an edge. Notch 22 is provided to help removing plow bit 2 from bit holder 4. Specifically, after removal of securing pin 6, plow bit 2 may be still stuck in recess 34 of bit holder 4, for example, due to particle ingress. To remove plow bit 2, a tip of a tool such as a chisel may be placed at notch 22. By hitting the chisel with a hammer, plow bit 2 may loosen such that the same is pivotable out of bit holder 4.

Bit shank 10 is formed by concave front shank face 24, a convex rear shank face 26, two lateral shank faces 28 (one of which is visible in FIGS. 1 and 2), and a bottom shank face 29. Rear shank face 26 is disposed on an opposite side of bit shank 10 with respect to front shank face 24. First and second lateral shank faces 28 are each connected to front shank face 24 and rear shank face 26, and are disposed on opposite sides of bit shank 10.

At a top section of bit shank 10, the same is connected to bit head 8. In addition, in one of lateral shank faces 28, a first groove 30 extends from front shank face 24 in direction of rear shank face 26 of bit shank 10. For example, groove 30 may connect front shank face 24 and rear shank face 26.

A clamping member 31 is disposed in a recess 33 in lateral shank face 28. Said clamping member 31 is configured to clamp securing pin 6 in an assembled state to lock securing pin 6 in place. Clamping member 31 may comprise any suitable material including, but without limitation, plastics and alloys. Recess 33 is disposed in first groove 30, for example in a middle section of elongate first groove 30. Further details on the configuration of bit shank 10 are described when referring to FIG. 3.

Bit holder 4 is formed by a bit holder body 32 that includes a recess 34. Said recess 34 functions as an insert pocket for plow bit 2, particularly for bit shank 10 of plow bit 2. An insert opening 36 of recess 34 for plow bit 2 is disposed in a top face 38 of bit holder body 32.

In the shown embodiment, bit holder 4 is particularly configured to be welded to a pivotable bit carrier of a mining plow (not shown in FIG. 2). Specifically, bit holder 4 may be welded with its bottom face 40 to the bit carrier such that top face 38 of bit holder 4 faces the mining face. Alternatively or additionally, other techniques may be applied to connect bit holder 4 to the bit carrier of the mining plow.

In a front wall 42 of bit holder 4, a first throughhole 44 into recess 34 is disposed for mounting securing pin 6. Securing pin 6 longitudinally extends from a securing pin head 46 to a securing pin tip 47. Further, securing pin 6 includes a constriction 48 configured to engage with clamping member 31 in lateral shank face 28 of bit shank 10 in an assembled state such that securing pin 6 locks plow bit 2 in recess 34 of bit holder 4.

In the shown embodiment, securing pin 6 has a circular cross-sectional area, which allows inserting securing pin 6 irrespective of an orientation (rotary position) of securing pin 6 about its longitudinal axis. Alternatively, securing pin 6 may include any other cross sectional area, for example, a polygonal cross sectional area.

Figure 3:
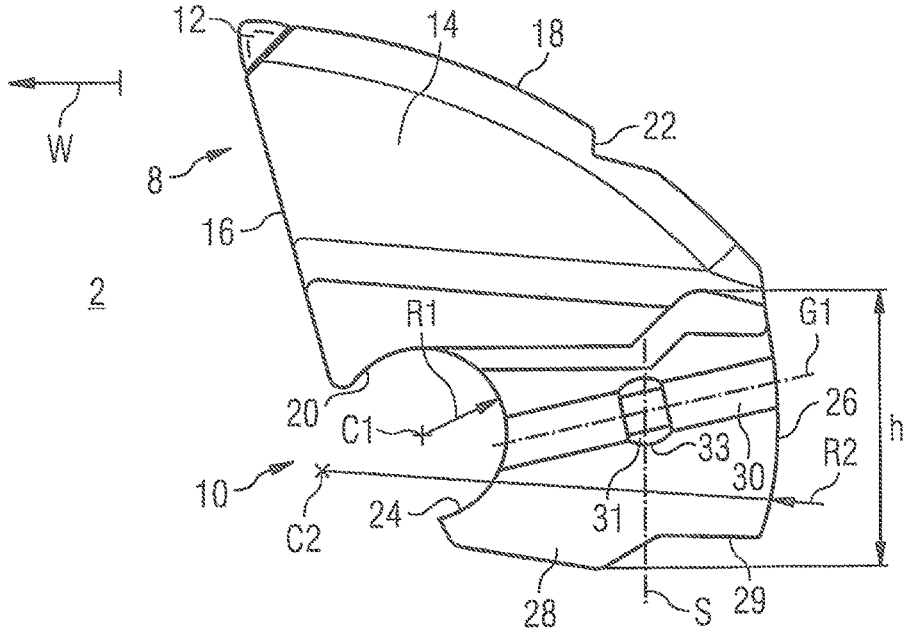
FIG. 3 shows a side view of the plow bit.

Turning to FIG. 3, which shows a side view of plow bit 2 to particularly explain the configuration of bit shank 10.

Bit shank 10 extends along a bit shank axis S being substantially perpendicular to working direction W. Further, bit shank 10 has a height h along shank axis S.

Front shank face 24 of shank 10 is concave about a first axis of curvature C1 being perpendicular to working direction W and shank axis S. Specifically, front shank face 24 is concavely formed as circular arc including a first radius R1.

Similarly, rear shank face 26 is convex about a second axis of curvature C2 being parallel to and spaced apart from first axis of curvature C1. In the shown configuration, rear shank face 26 is convexly formed as circular arc including a second radius R2. Alternatively or additionally, rear shank face 26 may include one or a series of flat face sections being inclined to one another resulting in a concave shape.

Moreover, in some embodiments, rear shank face 26 may extend substantially along entire height h. In other words, rear shank face 26 may be the sole face at a rear side of bit shank 10.

In the shown embodiment, first radius R1 of front shank face 24 and bottom head face 20 may be within a range between 20 mm and 40 mm, particularly 30 mm. Further, second radius R2 of rear shank face 26 may be within a range between 120 mm and 220 mm, particularly 170 mm. Regarding a relationship between first radius R1 to second radius R2, the former may be smaller than the latter, for example, with a ratio within a range between 1:11 and 1:6, particularly 1:8.5.

As can also be seen in FIG. 3, first groove 30 extends in lateral shank face 28 along a first groove axis G1 being inclined with respect to working direction W and shank axis S. The angle of inclination confined between shank axis S and first groove axis G1 may be smaller than 90°, for example, within a range between 64° and 89°, particularly 77°. Alternatively, groove axis G1 may be perpendicular to shank axis S.

Instead of first groove 30, bit shank 10 may include a shank throughhole (not shown) extending between front shank face 24 and rear shank face 26 to receive a securing pin. Said shank throughhole may extend along a shank throughhole axis, which may be inclined with respect to working direction W and shank axis S. The angle of inclination confined between shank axis S and shank throughhole axis may be similar to the angle between shank axis S and first groove axis G1.

Figure 4:
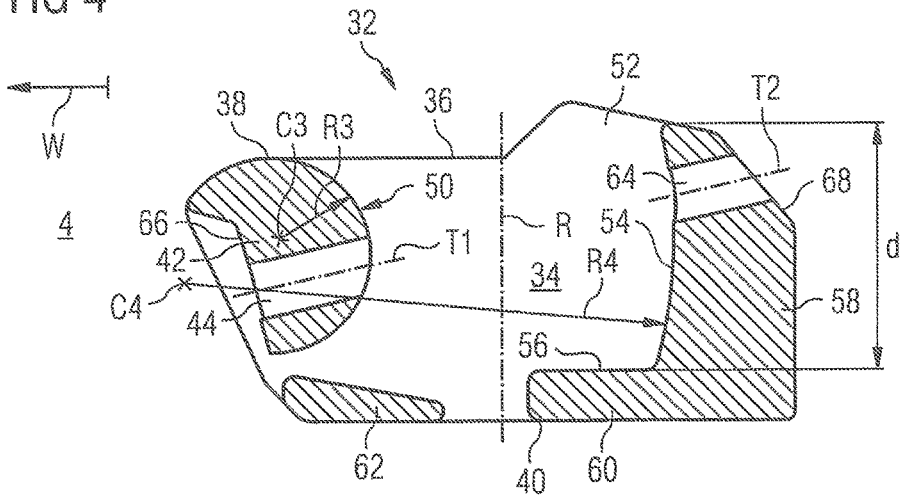
FIG. 4 shows a cut view of the bit holder.

Referring to FIG. 4, a cut view of bit holder 4 in a vertical plane is shown such that particularly the configuration of recess 34 is made visible.

Recess 34 in holder body 32 is configured to receive plow bit 2, particularly bit shank 10 of plow bit 2. Further, recess 34 has recess axis R, and a recess depth d in direction of recess axis R. As can be seen in the exemplary embodiment shown in FIG. 4, a depth of recess 34 may be not equal along a length of recess 34, wherein the length of recess 34 extends in the drawing plane of FIG. 4. Accordingly, depth d as used herein relates to a depth between opening 36 in top face 38 of holder body 32 and a bottom recess face 56 of recess 34. That depth d may be considered as an average depth of recess 34.

Further, recess 34 includes a convex front recess face 50, two inclined lateral recess faces 52 (only one visible in FIG. 4), and concave rear recess face 54. Said rear recess face 54 opposes front recess face 50 of recess 34 and delimits rear wall 58. In the shown embodiment, rear recess face 54 extends substantially entirely along depth d of recess 34.

Besides rear wall 58 and front wall 42, which is delimited by front recess face 50, holder body 32 of bit holder 4 further comprises a first bottom wall 60 connected to rear wall 58 and delimited by bottom recess face 56 of recess 34. First bottom wall 60 functions as a supporting wall for bit shank 10 of plow bit 2 (see, for example, FIG. 3) in an assembled state to absorb and accommodate forces acting on plow bit 2 during cutting operation. A suitable material strength of first bottom wall 60 may ensure that first bottom wall 60 can absorb and accommodate the cutting forces. For example, a suitable material strength may be within a range of ⅛ to ¼ of depth d.

Further, a second bottom wall 62 is disposed below front wall 42. A gap may be provided between first and second bottom walls 60 and 62.

Although not visible in the cut view of FIG. 4, holder body 32 further includes two lateral walls, each being delimited by a lateral recess face, one of which being indicated in FIG. 4 by reference sign 52. Those two lateral recess faces 52 are inclined with respect to one another in direction of recess axis R to mate with lateral faces of bit shank 10 in an assembled state.

Two throughholes 44 and 64 extend through front wall 42 and rear wall 58, respectively. Specifically, first throughhole 44 extends along a first throughhole axis T1 between a front outer face 66 of holder body 32 and front recess face 50. Likewise, second throughhole 64 extends between rear recess face 54 of recess 34 and a rear outer face 68 of holder body 32 along a second throughhole axis T2. First and second throughholes axes T1 and T2 are aligned with one another, and inclined with respect to recess axis R. The angle of inclination confined between axes T1, T2 and recess axis R may correspond to that between shank axis S and groove axis G1 (see FIG. 3).

Front recess face 50 and rear recess face 54 are configured to mate with front shank face 24 and rear shank face 26, respectively. In the shown configuration, front recess face 50 is convexly formed as a circular arc about a third axis of curvature C3 being perpendicular to working direction W and recess axis R. Likewise, rear recess face 54 is concavely formed as a circular arc about a fourth axis of curvature C4 being parallel to and spaced apart from third axis of curvature C3. During assembly and in the assembled state, axes C1 and C3 are aligned with one another. The same applies to axes C2 and C4.

Additionally, radii R3 and R4 of and relationships between front and rear recess faces 50 and 54 may be equal to radii of and relationships between first radius R1 of front shank face 24 and second radius R2 of shank rear face 26, respectively.

Figure 5:
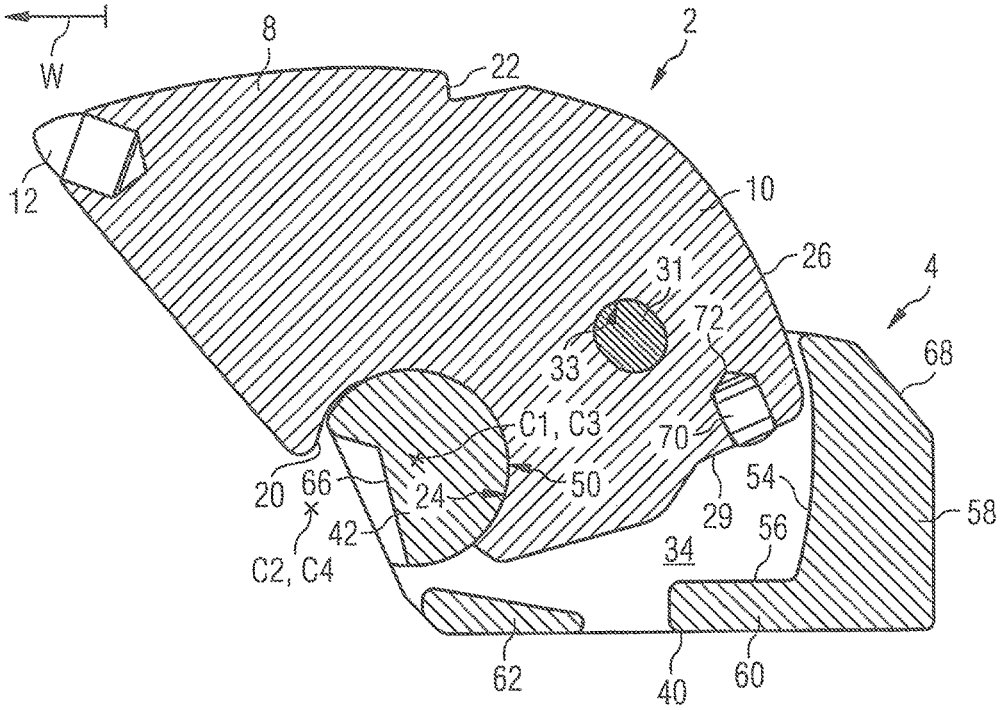
FIG. 5 shows a cut view of the plow bit assembly during assembly.

Referring to FIG. 5, assembly of plow bit 2 in recess 34 of bit holder 4 is shown in a vertical cut view. It should be noted that the vertical cut plane of FIG. 5 is not identical to the vertical cut plane of FIG. 4. Specifically, the vertical cut plane of FIG. 5 cuts plow bit 2 and holder 4 in two halves, whereas the vertical cut plane of FIG. 4 cuts bit holder 4 in two sections at about ⅓ of a bit holder width, the depicted section being the one with the smaller width.

For assembling plow bit 2 and bit holder 4, plow bit 2 is pivoted into recess 34 of bit holder 4 by a sliding contact between front shank face 24 and front recess face 50.

In case first and third axes of curvature C1 and C3 are parallel to and spaced apart from second and fourth axes of curvature C2 and C4 as, for example, shown in FIG. 4, rear shank face 26 and rear recess face 54 may not contact each other during pivoting. In other words, during pivoting, a clearance may be provided between rear shank face 26 and rear recess face 54. This may result in a reduced friction between plow bit 2 and bit holder 4, which may ease pivoting.

Generally, pivoting of plow bit 2 into and out of holder 4 during assembly and disassembly may be eased if an area of contacting faces between plow bit 2 and holder 4 is maintained small during pivoting. Reducing the contact area may be also achieved by configuring lateral faces of bit shank 10 and recess 34 in an inclined manner such that contact between one another may be made in an assembled state only.

Bit shank 10 further includes a biasing member 70 that is disposed in a recess 72 in bottom shank face 29. Biasing member 70 may be made of any suitable material, for example, comprising plastics. During pivoting, biasing member 70 may not contact bottom recess face 56 of holder body 32.

Turning to FIG. 6 which depicts plow bit 2, bit holder 4, and securing pin 6 in an assembled state after pivoting plow bit 2 into bit holder 4, and inserting securing pin 6. As can be seen, in an assembled state, rear shank face 26 and rear recess face 54 contact each other. Moreover, bottom shank face 29 and bottom recess face 56 may be also in contact with one another.

Plow bit 2 is hold in recess 34 by securing pin 6 extending through first throughhole 44 and first groove 30. To secure securing pin 6 against slipping out, the same is clamped in place by clamping member 31 that encompasses constriction 48 of securing pin 6.

In some embodiments, securing pin 6 may further extend into second throughhole 64 in rear wall 58 of bit holder 4.

To disassemble plow bit assembly 1, securing pin 6 has to be removed. In case head 46 of securing pin 6 is not broken, securing pin 6 may be levered out of first throughhole 44 and first groove 30 by a suitable tool that is applied at head 46. Additionally or alternatively, securing pin 6 may be pushed out by a suitable tool inserted through second throughhole 64. For example, an elongate tool having a tool tip for contacting pin tip 47 of securing pin 6, and a tool head as a contact face for a hammer may be used to push securing pin 6 out of first throughhole 44.

To further disassemble plow bit assembly 1, plow bit 2 has to be pivoted out of recess 34. In case plow bit 2 may be stuck in recess 34 due to the influence of particles stuck between bit shank 10 and recess 34, a chisel applied to notch 22 may be used to loosen plow bit 2.

Referring to FIG. 7, a further cut view of plow bit assembly 1 in an assembled state is shown. As already noted before, the cutting plane of FIG. 7 is indicated by line A-A in FIG. 2.

In the embodiment shown in FIG. 7, an inclination between lateral shank faces 28 and lateral recess faces 52 is made visible due to the presence of inclination angle $\alpha$. Angle $\alpha$ may be within a range between 1° and 10°, particularly 3°.

As can be further seen in FIG. 7, a first lateral recess face 52 includes an elongate second groove 74 to receive securing pin 6 in an assembled state. Second groove 74 opposes first groove 30 in first lateral shank face 28 of bit shank 10. Further, second groove 74 extends between front recess face 50 and rear recess face 54 along a second groove axis T2 (not shown), which is aligned with first and second throughhole axes T1 and T2 in the assembled state.

In the assembled state, biasing member 70 contacts bottom recess face 56 and inner faces of recess 72. As a result, plow bit 2 is biased by biasing member 70 against bottom recess face 56 and securing pin 6 such that plow bit 2 may be firmly hold in place during operation.

Figure 8:
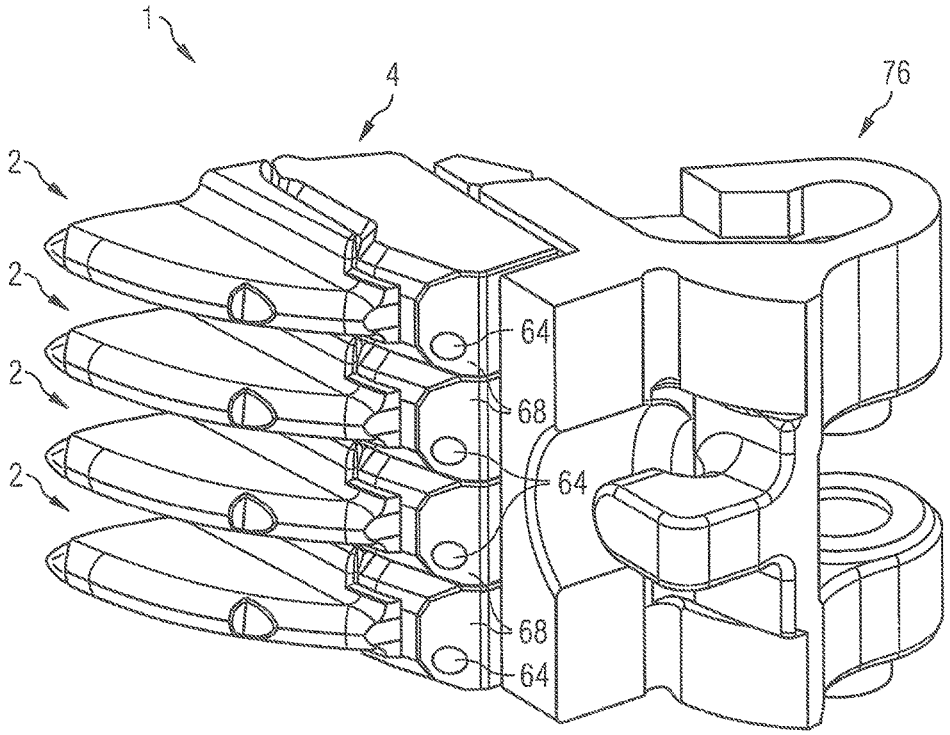
FIG. 8 shows a cutting bit carrier of a mining plow equipped with a group of four plow bit assemblies according to the present disclosure.

In FIG. 8, a cutting bit carrier 76, which may be pivotably mounted to a mining plow is shown. Cutting bit carrier 76 is equipped with four exemplary plow bit assemblies 1.

As can be seen, second throughhole 64 opens in rear holder body outer face 68 at an accessible position. Specifically, due to inclined arrangement of throughhole axes T1 and T2, second throughhole 64 opens in an upper section of rear outer face 68. That arrangement allows to easily insert a tool into second throughhole 64 to push out securing pin 6 if desired.

INDUSTRIAL APPLICABILITY

The plow bit assembly as exemplary disclosed herein is applicable in mining plows reciprocating along a longwall mining face in a longwall mining installation to extract material such as coal from the longwall face. Further, the plow bit assembly is particularly applicable in longwall mining applications providing only little space for maintenance of the mining plow in the field.

Plow bit assembly 1 features multiple improvements that may ease and quicken assembly and disassembly of the plow bit assembly under field conditions.

Pivoting of plow bit 2 into bit holder 4, which is particularly facilitated due to a mating configuration of rounded front shank face 24 and front recess face 50, may ease assembly and may require less space compared to plow bit assemblies, in which a plow bit is pushed (plugged) into an insert pocket of a bit holder. Particularly bottom plow bits of a mining plow may be easier to remove in accordance with the present disclosure as lifting the mining plow body and/or pivoting a bit carrier to an accessible position may be not necessary to remove a worn plow bit and to insert a new one.

Moreover, complication of assembly and disassembly due to particle ingress between bit holder recess and plow bit shank may be reduced since an area of contacting faces of bit holder recess and plow bit shank may be relatively low during pivoting as described herein. As a result, only low friction may occur. Providing notch 22 may further quicken removal as it may allow to quickly loosen a stuck plow bit 2.

In addition, securing pin 6 is disposed in an inclined manner, which allows to remove securing pin 6 by applying hammer and/or chisel impacts on the securing pin tip 47, for example, in cases in which a lever tool cannot be applied at a worn or demolished securing pin head 46.

FURTHER ASPECTS

In the following, further aspects of the present disclosure which may be provided separately are described. Embodiments of the below aspects may include individual or groups of features as described herein.

According to a further aspect of the present disclosure, a bit holder of a mining plow may comprise a holder body including a front wall and a recess. The recess may have a recess axis and may be configured to receive a plow bit. The front wall may include a first throughhole extending along a first throughhole axis. The throughhole axis may be inclined to the recess axis of the recess. The angle of inclination may be smaller than 90°.

In some embodiments of the above aspect, the bit holder may further comprise a rear wall including a second throughhole extending along a second throughhole axis. The second throughhole axis may be aligned with the first throughhole axis.

In some embodiments of the above aspect, the recess may include a first lateral recess face having an elongate groove. The elongate groove may extend along a groove axis being aligned with the first throughhole axis.

According to yet a further aspect of the present disclosure, a plow bit of a mining plow may comprise a bit shank. The bit shank may include a lateral face. The lateral face may include a groove for a securing pin. The groove may extend along a groove axis being inclined to a shank axis of the bit shank. The angle of inclination may be smaller than 90°.

As already described herein, inclined throughholes and groove may allow pushing out securing pin if disassembling the plow bit assembly as inclined second throughhole may be accessible for a chisel of a miner without great effort.

According to yet a further aspect of the present disclosure, a plow bit of a mining plow may comprise a bit shank. The bit shank may include a biasing member disposed in a bottom face of the bit shank.

In an assembled state, the biasing element may bias the bit shank of the plow bit to tightly hold the same in place.

According to yet a further aspect of the present disclosure, a plow bit may comprise a bit head. The bit head may include a notch in a rear head face of the bit head.

The notch may allow to loosen the plow bit that may be stuck in a recess of a bit holder, for example, due to particle ingress. A tip of a tool such as a chisel may be placed at notch 22. By hitting the chisel with a hammer, plow bit 2 may loosen such that the same is pivotable out of bit holder 4.

Although the preferred embodiments of this invention have been described herein, improvements and modifications may be incorporated without departing from the scope of the following claims.

The invention claimed is:

1. A bit holder for a plow bit of a mining plow, the bit holder comprising:

a holder body including a front wall and a recess, wherein the recess is configured to receive the plow bit, the recess further including a front recess face, which is convex and delimits the front wall;

the front wall includes a first throughhole opening in the front recess face;

a rear wall including a second throughhole extending along a second throughhole axis (T2) being aligned with a first throughhole axis (T1) of the first throughhole; and a second groove extending along a second groove axis (G2) in a first lateral recess face of the recess, the second groove axis (G2) being aligned with the first throughhole axis (T1) of the first throughhole.

2. The bit holder of claim 1, wherein the front recess face is convexly formed as circular arc to allow pivoting the plow bit into the recess via a sliding contact.

3. The bit holder of claim 1, wherein the recess has a recess axis (R) and further comprises a rear recess face opposing the front recess face;

the front recess face is convex about a front axis of curvature (C3) being perpendicular to the recess axis (R);

the rear recess face is concave about a rear axis of curvature (C4) being perpendicular to the recess axis (R); and the front axis of curvature (C3) and the rear axis of curvature (C4) are parallel and spaced apart.

4. The bit holder of claim 1, wherein the first throughhole extends along the first throughhole axis (T1) being inclined to a recess axis (R) of the recess, an angle of the inclination being smaller than 90°.

5. The bit holder of claim 1, wherein the recess further comprises a second lateral recess face opposing the first lateral recess face, the first and second lateral recess faces being inclined with respect to one another.

6. A plow bit assembly for a mining plow, the plow bit assembly comprising:

a bit holder, including:

a holder body including a front wall;

a recess disposed in the holder body, including a front recess face, which is convex and delimits the front wall; and a first throughhole opening extending from the front wall to the front recess face; and a plow bit including a bit shank, the bit shank having a shank axis (S) and being configured to be inserted into the recess of the bit holder, the bit shank including:

a front shank face being concave about a first axis of curvature (C1) perpendicular to the shank axis (S);

a rear shank face disposed opposite the front shank face, wherein the rear shank face is convex about a second axis of curvature (C2) perpendicular to the shank axis (S);

a first lateral shank face connected to the front shank face and the rear shank face; and a first groove on the first lateral shank face, the first groove extending from the front shank face in direction of the rear shank face, wherein the front recess face of the bit holder and the front shank face of the plow bit are configured to mate with one another to allow pivoting the plow bit into and out of the recess of the bit holder by a sliding contact between the front recess face and the front shank face.

7. The plow bit assembly of claim 6, wherein the first groove extends along a first groove axis (G1) inclined relative to the shank axis (S) of the bit shank at an angle of inclination smaller than 90°.

8. The plow bit assembly of claim 6, wherein the bit shank further includes a second lateral shank face disposed opposite the first lateral shank face, the second lateral shank face connecting the front shank face and the rear shank face, the first lateral shank face being inclined relative to the second lateral shank face.

9. The plow bit assembly of claim 6, wherein the first throughhole extends along a first throughhole axis (T1) inclined relative to a recess axis (R) of the recess at an angle of inclination smaller than 90°.

10. The plow bit assembly of claim 6, wherein the recess further comprises a first lateral recess face and a second lateral recess face opposing the first lateral recess face, the first lateral recess face being inclined relative to the second lateral recess face.

* * * * *